US011156123B2

(12) United States Patent
Sakamoto et al.

(10) Patent No.: US 11,156,123 B2
(45) Date of Patent: Oct. 26, 2021

(54) TURBOCHARGER

(71) Applicant: MITSUBISHI HEAVY INDUSTRIES ENGINE & TURBOCHARGER, LTD., Sagamihara (JP)

(72) Inventors: Keigo Sakamoto, Tokyo (JP); Nariaki Seike, Sagamihara (JP); Sosuke Irie, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 59 days.

(21) Appl. No.: 16/610,152

(22) PCT Filed: Oct. 30, 2017

(86) PCT No.: PCT/JP2017/039072
§ 371 (c)(1),
(2) Date: Nov. 1, 2019

(87) PCT Pub. No.: WO2019/087231
PCT Pub. Date: May 9, 2019

(65) Prior Publication Data

US 2020/0056505 A1 Feb. 20, 2020

(51) Int. Cl.
*F01D 25/16* (2006.01)
*F01D 25/12* (2006.01)
*F01D 25/24* (2006.01)

(52) U.S. Cl.
CPC ..... *F01D 25/162* (2013.01); *F01D 25/125* (2013.01); *F01D 25/243* (2013.01)

(58) Field of Classification Search
CPC .... F01D 11/005; F01D 25/125; F01D 25/162; F01D 25/243; F01D 25/26; F02B 39/00;
(Continued)

(56) References Cited

U.S. PATENT DOCUMENTS 4,482,303 A 11/1984 Acosta
9,863,262 B2 * 1/2018 Shudo ..... F01D 25/24
(Continued)

FOREIGN PATENT DOCUMENTS

CN 102102587 A 6/2011
CN 107060912 A1 8/2017
(Continued)

OTHER PUBLICATIONS

International Search Report for International Application No. PCT/JP2017/039072, dated Jan. 23, 2018.
(Continued)

*Primary Examiner* — Jesse S Bogue
(74) *Attorney, Agent, or Firm* — Birch, Stewart, Kolasch & Birch, LLP

(57) ABSTRACT

A turbocharger includes a shaft, a bearing housing, a turbine housing, and a uniting member. The bearing housing includes a first connection section protruded in a radial direction of the shaft, the first connection section having a first face extended in the radial direction, the turbine housing includes a second connection section protruded in the radial direction of the shaft, the second connection section having a second face extended in the radial direction and being faced to the first face, the uniting member interposes the first connection section and the second connection section by being fitted to the first connection section and the second connection section from the outside, and the first face and/or the second face include a ring-shaped concave portion on an inner side in the radial direction of the shaft with a sealing member arranged at the ring-shaped concave portion.

11 Claims, 7 Drawing Sheets

(58) Field of Classification Search
CPC ..... F05D 2220/40; F05D 2240/55; F01N 13/1805; F16B 7/0453; F16B 7/182; F16B 9/02; F16L 23/04; F16L 23/08
See application file for complete search history.

(56) References Cited

U.S. PATENT DOCUMENTS

| | | | | |
|---|---|---|---|---|
| 10,895,226 | B2 * | 1/2021 | Watanabe | F01D 25/265 |
| 10,954,816 | B2 * | 3/2021 | Kitamura | F01D 25/24 |
| 2011/0142604 | A1 | 6/2011 | Schumnig et al. | |
| 2011/0254268 | A1 | 10/2011 | Johnson et al. | |
| 2015/0037146 | A1 | 2/2015 | Yamaguchi et al. | |
| 2015/0110600 | A1 | 4/2015 | Mack et al. | |
| 2016/0356181 | A1 * | 12/2016 | Karamavruc | F01D 25/243 |
| 2017/0184238 | A1 | 6/2017 | Bruestle | |
| 2017/0226895 | A1 | 8/2017 | Köhnlein et al. | |

FOREIGN PATENT DOCUMENTS

| | | | |
|---|---|---|---|
| DE | 102011016223 | A1 | 11/2011 |
| DE | 10 2013 111 561 | A1 | 4/2015 |
| JP | 59-32131 | A | 2/1984 |
| JP | 63-128243 | U | 8/1988 |
| JP | 3-292489 | A | 12/1991 |
| JP | 7-189724 | A | 7/1995 |
| JP | 2013-174129 | A | 9/2013 |
| JP | 2015-25460 | A | 2/2015 |
| JP | 2015-518114 | A | 6/2015 |
| JP | 2017-116102 | A | 6/2017 |

OTHER PUBLICATIONS

Written Opinion of the International Searching Authority for International Application No. PCT/JP2017/039072, dated Jan. 23, 2018, with English translation of the Written Opinion dated Dec. 23, 2019.
Office Action dated Dec. 2, 2020 issued in counterpart Chinese Application No. 201780089797.9 with English Translation.
Extended European Search Report for European Application No. 17930265.8, dated May 27, 2020.
Japanese Office Action for Japanese Application No. 2019-549987, dated Jun. 2, 2020, with an English translation.

* cited by examiner

TURBOCHARGER

TECHNICAL FIELD

The present disclosure relates to a turbocharger including a bearing housing, a turbine housing, and a uniting member that is fitted to connection sections thereof from the outside.

BACKGROUND

There has been known a turbocharger in which a turbine wheel is rotatably arranged in an assembly of a turbine housing and a bearing housing (e.g., Patent Document 1). According to the turbocharger, energy exhausted from an engine is utilized as power to rotate the turbine wheel and air is supercharged to the engine with use of the rotation of the turbine wheel. The exhaust gas is supplied toward the turbine wheel after passing through a scroll flow path being a whorl-shaped exhaust gas flow path formed in the turbine housing.

Patent Document 1 discloses a uniting configuration with which the turbine housing and the bearing housing are united by a uniting member fitted from the outside to interpose connection sections of the turbine housing and the bearing housing with a back plate (heat-insulating plate) interposed between the connection sections. The uniting configuration performs sealing to prevent outward leakage of exhaust gas by the back plate being interposed between the turbine housing and the bearing housing.

Patent Document 2 discloses a turbocharger in which a flange portion of a bearing housing is interposed between a flange of a flanged bolt and an inner end face of a turbine housing. The interposing is performed by screwing the flanged bolt into a bolt hole formed on an outer circumferential side of a connection section of the turbine housing in a state that the flange portion of the bearing housing is fitted to a stepped portion arranged on an inner circumferential side of the connection section. Here, the stepped portion has an inner end face concaved in the axial direction from an end face on the outer circumferential side of the connection section. In the turbocharger, ring-shaped space being rectangular in section is formed between the flange portion of the bearing housing and the inner end face of the turbine housing and a sealing ring is arranged in the ring-shaped space. Accordingly, sealing is provided to prevent outward leakage of exhaust gas.

CITATION LIST

Patent Literature

Patent Document 1: JP2013-174129A
Patent Document 2: JP2015-25460A

SUMMARY

Technical Problem

Recently, temperature of combustion gas of an engine tends to increase for improvement of engine power, and accordingly, temperature of exhaust gas exhausted from an engine tends to increase as well. Since high temperature of exhaust gas causes large thermal expansion and large thermal deformation of a turbine housing and a bearing housing, there arises an increasing fear that clearance is formed between the turbine housing and the bearing housing and exhaust gas leaks outward through the clearance.

For example, in the turbocharger disclosed in Patent Document 1, there is a fear that thermal expansion and thermal deformation of the turbine housing and the bearing housing under high temperature cause reduction of force generated by the turbine housing and the bearing housing to fasten the back plate, and accordingly, cause clearance to appear between the turbine housing and the back plate and exhaust gas to leak outward through the clearance.

Further, in the turbocharger disclosed in Patent Document 2, there is a fear that thermal expansion and thermal deformation of the turbine housing and the bearing housing under high temperature cause the connection section of the turbine housing to be extended in the axial direction, and accordingly, cause reduction of force generated by the flange of the flanged bolt and the inner end face of the turbine housing to fasten the flange portion of the bearing housing. When the force to fasten the flange portion of the bearing housing is reduced, force to press the sealing ring is reduced and sealing function is deteriorated. Accordingly, exhaust gas may leak outward.

In this regard, it is an object of at least one embodiment of the present invention to provide a turbocharger capable of suppressing outward leakage of exhaust gas with a sealing member capable of providing excellent sealing function even when thermal expansion and thermal deformation occur at the turbine housing and the bearing housing.

Solution to Problem (1) A turbocharger according to at least one of embodiments of the present invention includes a shaft, a bearing housing accommodating a bearing rotatably supporting the shaft, a turbine housing accommodating a turbine wheel arranged at one end of the shaft in an axial direction, and a uniting member uniting the bearing housing and the turbine housing. Here, the bearing housing includes a first connection section protruded in a radial direction of the shaft, the first connection section having a first face extended in the radial direction, the turbine housing includes a second connection section protruded in the radial direction of the shaft, the second connection section having a second face extended in the radial direction and being faced to the first face, the uniting member interposes the first connection section and the second connection section by being fitted to the first connection section and the second connection section from the outside, and at least one of the first face and the second face includes a ring-shaped concave portion on an inner side in the radial direction of the shaft with a sealing member arranged at the ring-shaped concave portion.

According to the configuration described above as (1), the bearing housing includes the first connection section protruded in the radial direction of the shaft and the first connection section includes the first face extended in the radial direction. The turbine housing includes the second connection section protruded in the radial direction of the shaft and the second connection section includes the second face extended in the radial direction and faced to the first face of the first connection section. The uniting member interposes the first connection section and the second connection section by being fitted to the first connection section and the second connection section from the outside with the first face of the first connection section and the second face of the second connection section faced to each other.

Thus, since the uniting member is fitted to the first connection section and the second connection section from the outside to interpose the first connection section and the second connection section, the turbine housing and the bearing housing can be extended in the axial direction of the shaft due to thermal expansion and thermal deformation under high temperature. Since the turbine housing is more influenced by heat of exhaust gas than the bearing housing, the turbine housing is extended in the axial direction of the shaft more than the bearing housing. Accordingly, the second connection section becomes close to the first connection section so that clearance between the first face and the second face becomes small or zero. Owing to that the first connection section and the second connection section become close to each other under the thermal influence of exhaust gas, the sealing member arranged at the ring-shaped concave portion on the radially inner side of the first face and/or the second face is urged to be compressed in the axial direction of the shaft by the ring-shaped concave portion, the first face, and/or the second face. Accordingly, since the sealing member is reliably interposed by the ring-shaped concave portion, the first face, and/or the second face, the sealing member can suppress outward leakage of exhaust gas and provide excellent sealing function.

(2) In some embodiments, in the configuration described above as (1), the uniting member includes a first end section locked on a third face of the first connection section, the third face being on an opposite side to the first face in the axial direction of the shaft, a second end section locked on a fourth face of the second connection section, the fourth face being on an opposite side to the second face in the axial direction of the shaft, and a joint section joined to the first end section and the second end section.

According to the configuration described above as (2), since the uniting member includes the first end section locked on the third face of the bearing housing, the second end section locked on the fourth face of the turbine housing, and the joint section joined to the first end section and the second end section, the first connection section and the second connection section are fitted to a fitting concave segment formed by the first end section, the second end section, and the joint section on the inner side thereof in the radial direction of the shaft. Here, since the first end section and the second end section are locked on the third face of the first connection section and the fourth face of the second connection section respectively, the uniting member can prevent the first connection section and the second connection section from being distanced from each other by a predetermined distance or larger in the axial direction of the shaft. Accordingly, the sealing member performing sealing between the first connection section and the second connection section can provide excellent sealing function.

(3) In some embodiments, in the configuration described above as (2), the first connection section includes a taper section formed on the third face so that thickness of the first connection section gradually becomes larger toward the inner side in the radial direction of the shaft from an outer circumferential face, the second connection section includes a taper section formed on the fourth face so that thickness of the second connection section gradually becomes larger toward the inner side in the radial direction of the shaft from an outer circumferential face, and the first end section and the second end section of the uniting member are extended in directions inclined to the radial direction of the shaft so that distal ends thereof are to be more distanced from each other.

According to the configuration described above as (3), the first connection section includes the taper section formed on the third face so that thickness of the first connection section gradually becomes larger toward the inner side in the radial direction of the shaft from the outer circumferential face of the first connection section. Further, the second connection section includes the taper section formed on the fourth face so that thickness of the second connection section gradually becomes larger toward the inner side in the radial direction of the shaft from the outer circumferential face of the second connection section. Further, the first end section and the second end section of the uniting member are extended in the directions inclined to the radial direction of the shaft so that the distal ends thereof are to be more distanced from each other. Accordingly, since the first end section is locked in the taper section formed on the third face and the second end section is locked in the taper section formed on the fourth face, the uniting member can interpose the first connection section and the second connection section in the axial direction of the shaft as well as in the radial direction of the shaft. In a case that the second connection section of the turbine housing is extended outward in the radial direction of the shaft due to thermal expansion and thermal deformation under high temperature, fastening force of the uniting member exerted on the first connection section and the second connection section is increased. Accordingly, since the first connection section and the second connection section are firmly interposed by the uniting member, the sealing member performing sealing between the first connection section and the second connection section can provide excellent sealing function even under high temperature.

(4) In some embodiments, the turbocharger described above as any one of (1) to (3) further includes a back plate arranged between the turbine wheel and the bearing housing. Here, the bearing housing includes an end face formed on a side toward the turbine wheel with respect to the first connection section in the axial direction of the shaft and extended in the radial direction of the shaft, the turbine housing includes a back plate supporting section arranged on a side toward the turbine wheel with respect to the second connection section in the axial direction of the shaft and extended radially inward in the radial direction of the shaft, and the back plate is arranged so that an outer circumferential edge section extended in the radial direction of the shaft is interposed between the back plate supporting section and the end face.

According to the configuration described above as (4), compared to the sealing portion for exhaust gas formed by the back plate, the end face of the bearing housing, and the back plate supporting section of the turbine housing, the first connection section and the second connection section are arranged at positions farther in the axial direction of the shaft from the turbine wheel and the exhaust gas flow path through which exhaust gas flows toward the turbine wheel. Therefore, temperature increase due to exhaust gas is small and influences due to thermal expansion and thermal deformation are small as well. Accordingly, the sealing member performing sealing between the first connection section and the second connection section can provide excellent sealing function even under high temperature.

Further, temperature increase due to exhaust gas is also small at the sealing member performing sealing between the first connection section and the second connection section. Therefore, in a case that the sealing member is formed of a metal material, it is not necessary to adopt expensive heat-resistant alloy. Accordingly, it is possible to prevent cost increase of the sealing member and the turbocharger including the sealing member.

(5) In some embodiments, in the configuration described above as any one of (1) to (4), the ring-shaped concave portion is arranged at the second connection section.

According to the configuration described above as (5), since the sealing member arranged at the ring-shaped concave portion formed at the second connection section is interposed by the ring-shaped concave portion and the first face of the first connection section, the sealing member can provide excellent sealing function. Further, since the sealing member is arranged at the ring-shaped concave portion of the second connection section, dropping of the sealing member can be prevented at the time of assembling the bearing housing to the turbine housing and assembling operability can be improved.

(6) In some embodiments, in the configuration described above as any one of (1) to (4), the ring-shaped concave portion is arranged at the first connection section.

According to the configuration described above as (6), since the sealing member arranged at the ring-shaped concave portion formed at the first connection section is interposed by the ring-shaped concave portion and the second face of the second connection section, the sealing member can provide excellent sealing function. Further, since the sealing member is arranged at the ring-shaped concave portion of the first connection section, dropping of the sealing member can be prevented at the time of assembling the turbine housing to the bearing housing and assembling operability can be improved.

(7) In some embodiments, in the configuration described above as any one of (1) to (4), the ring-shaped concave portion is arranged at the second connection section and the first connection section.

According to the configuration described above as (7), since the sealing member is arranged between the ring-shaped concave portion formed at the first connection section and the ring-shaped concave portion formed at the second connection section and interposed by the ring-shaped concave portions, the sealing member can provide excellent sealing function. Further, since the ring-shaped concave portions are formed at both the first connection section and the second connection section, the sealing member can be arranged at the ring-shaped portion of the first connection section at the time when the turbine housing is assembled to the bearing housing and the sealing member can be arranged at the ring-shaped portion of the second connection section at the time when the bearing housing is assembled to the turbine housing. Accordingly, dropping of the sealing member can be prevented and flexibility and operability of assembling operation can be improved.

(8) In some embodiments, in the configuration described above as any one of (1) to (7), the bearing housing further includes a coolant flow path through which coolant flows, the coolant flow path being arranged on a further inner side than the ring-shaped concave portion in the radial direction.

According to the configuration described above as (8), since the coolant flow path through which coolant flows is formed in the bearing housing on the further inner side than the ring-shaped concave portion in the radial direction of the shaft, temperature increase at the first connection section and the second connection section can be suppressed and thermal expansion and thermal deformation at the first connection section, the second connection section, and the sealing member arranged therebetween can be lessened. Accordingly, the sealing member can provide excellent sealing function.

(9) In some embodiments, in the configuration described above as any one of (1) to (8), the sealing member is formed into a ring shape, and in section along the axial direction of the shaft, includes a first section to be in touch with the first connection section, a second section to be in touch with the second connection section, and a curved section having a predetermined curvature to join the first section and the second section.

According to the configuration described above as (9), since the sealing member is formed into a ring-shape, sealing can be ensured between the first connection section and the second connection section all over the circumference. Further, since the sealing member includes the first section, the second section, and the curved section having the curvature to join the first section and the second section, the sealing member is easily compressed in the axial direction of the shaft and a sealing function can be provided with resilience (elastic force) generated by the compression.

(10) In some embodiments, in the configuration described above as (9), the sealing member has a predetermined springback characteristic under conditions that a sectional width L satisfies $L=(DO-DI)/2$, a ratio between height and plate thickness H/T satisfies "$8.0 \leq H/T \leq 25.0$", a ratio between the height and curvature H/R satisfies "$2.0 \leq H/R \leq 6.0$", and a ratio between height and sectional width H/L satisfies "$0.5 \leq H/L \leq 3.5$", while the turbine wheel has a wheel diameter of 20 or more and 70 mm or less, coefficients of thermal expansion of the bearing housing and the turbine housing are the same, and regarding the sealing member, DO denotes an outer diameter, DI denotes an inner diameter, H denotes the height, T denotes the plate thickness, and R denotes the curvature of the curved section.

According to the configuration described above as (10), the turbine wheel has a wheel diameter of 20 mm or more and 70 mm or less. Such turbine wheel is preferable for the turbocharger for automobile use. Further, the coefficients of thermal expansion of the bearing housing and the turbine housing are the same. According to findings of the inventors, excellent sealing function can be provided by the sealing member satisfying the predetermined springback characteristic. Owing to that the sealing member satisfies the above-mentioned conditions, the predetermined springback characteristic can be satisfied in the turbocharger for automobile use and excellent sealing function can be provided.

Advantageous Effects

At least one embodiment of the present invention provides a turbocharger capable of suppressing outward leakage of exhaust gas with a sealing member capable of providing excellent sealing function even when thermal expansion and thermal deformation occur at the turbine housing and the bearing housing.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For example, an expression of relative or absolute arrangement such as "in a direction", "in a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For example, an expression of an equal state such as "same", "equal" and "uniform" shall not be construed as indicating only the state in which the feature is strictly equal, but also includes a state in which there is a tolerance or a difference that can still achieve the same function.

Further, for example, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
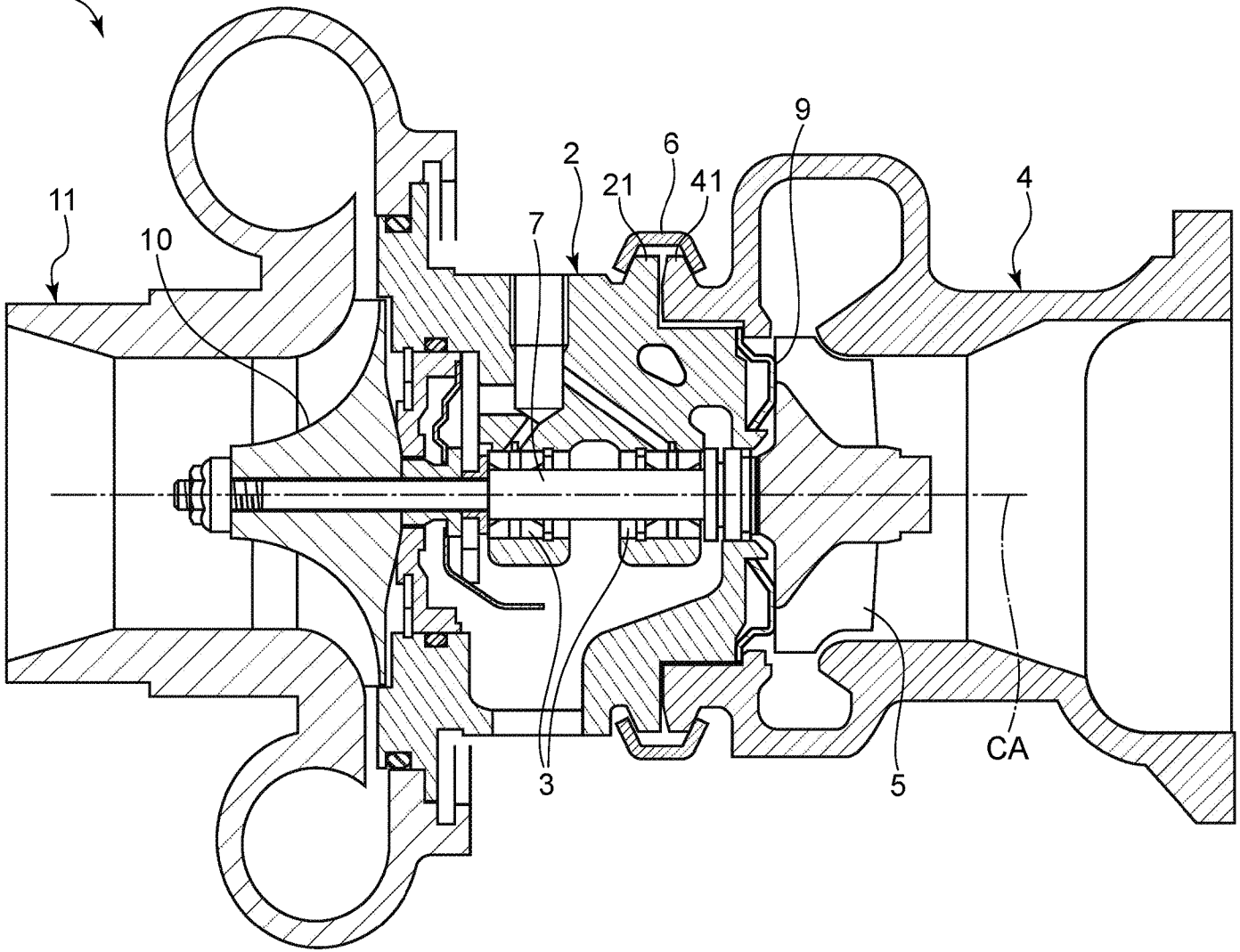
FIG. 1 is a schematic sectional view schematically illustrating an entire configuration of a turbocharger according to an embodiment of the present invention.

FIG. 1 is a schematic sectional view schematically illustrating an entire configuration of a turbocharger according to an embodiment of the present invention. In embodiments illustrated in FIGS. 1 to 8, a turbocharger 1 includes, as illustrated in FIG. 1, a shaft 7, a bearing housing 2 accommodating bearings 3 rotatably supporting the shaft 7, a turbine housing 4 accommodating a turbine wheel 5 arranged at one end of the shaft 7 in the axial direction (extension direction of the central axis CA), a compressor housing 11 accommodating an impeller 10 of a compressor arranged at the other end of the shaft 7 in the axial direction, and a uniting member 6 uniting the bearing housing 2 and the turbine housing 4.

As illustrated in FIG. 1, in the turbocharger 1, exhaust gas exhausted from an unillustrated engine is supplied to the turbine wheel 5 after passing through a whorl-shaped scroll flow path 48 formed in the turbine housing 4, so that the turbine wheel 5 is rotated about the center axis CA. The turbine wheel 5 is coaxially coupled with the impeller 10 of the compressor via the shaft 7. The shaft 7 is rotatably supported by a pair of the bearings 3 distanced from each other in the axial direction of the shaft 7. According to the above, the impeller 10 of the compressor is rotated about the center axis CA in with rotation of the turbine wheel 5 to supercharge air to an engine.

Figure 2:
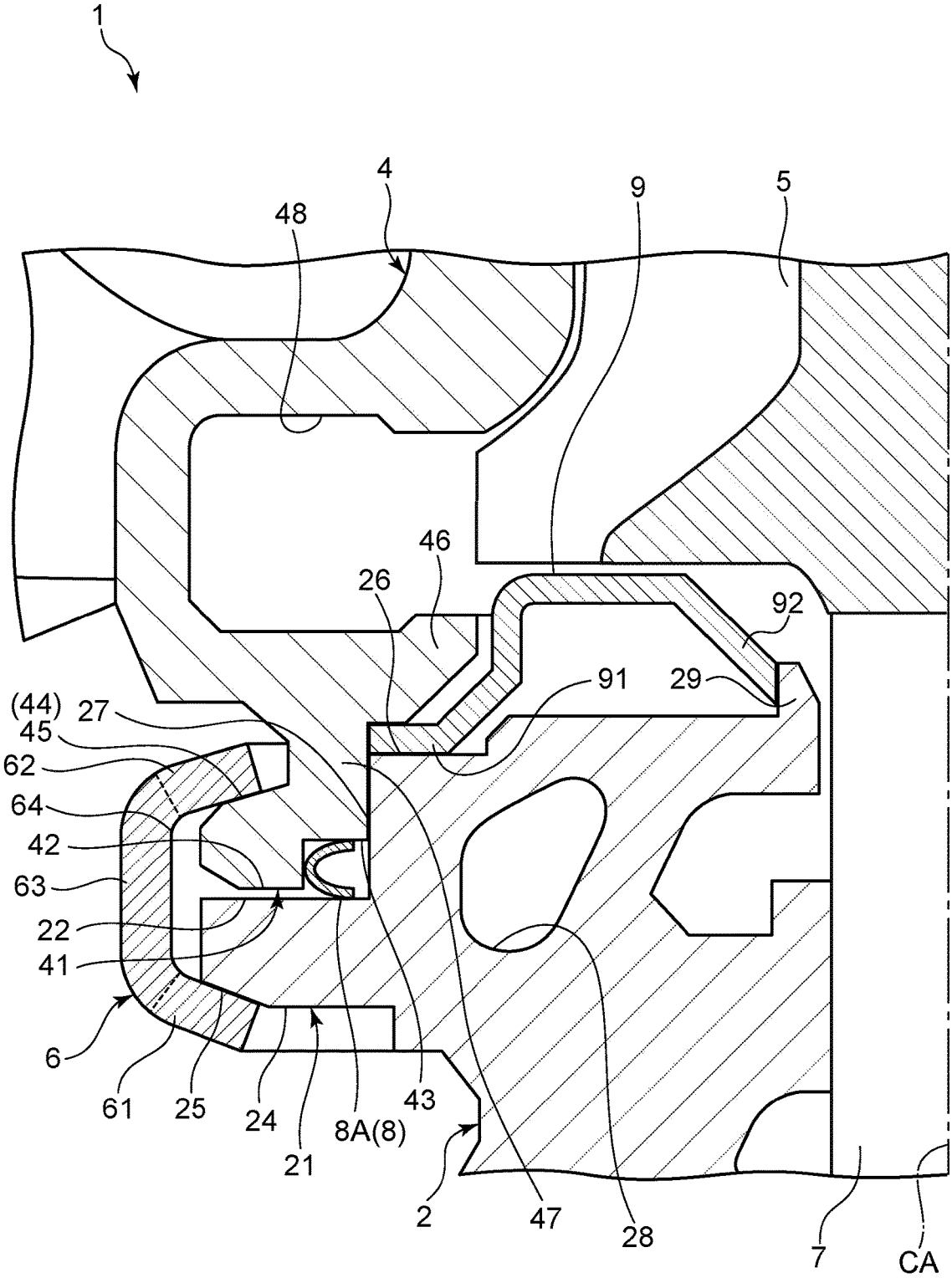
FIG. 2 is an enlarged partial sectional view for explaining a turbocharger according to the embodiment of the present invention, which schematically illustrates the turbocharger with a ring-shaped concave portion formed at a second connection section of a turbine housing.
Figure 3:
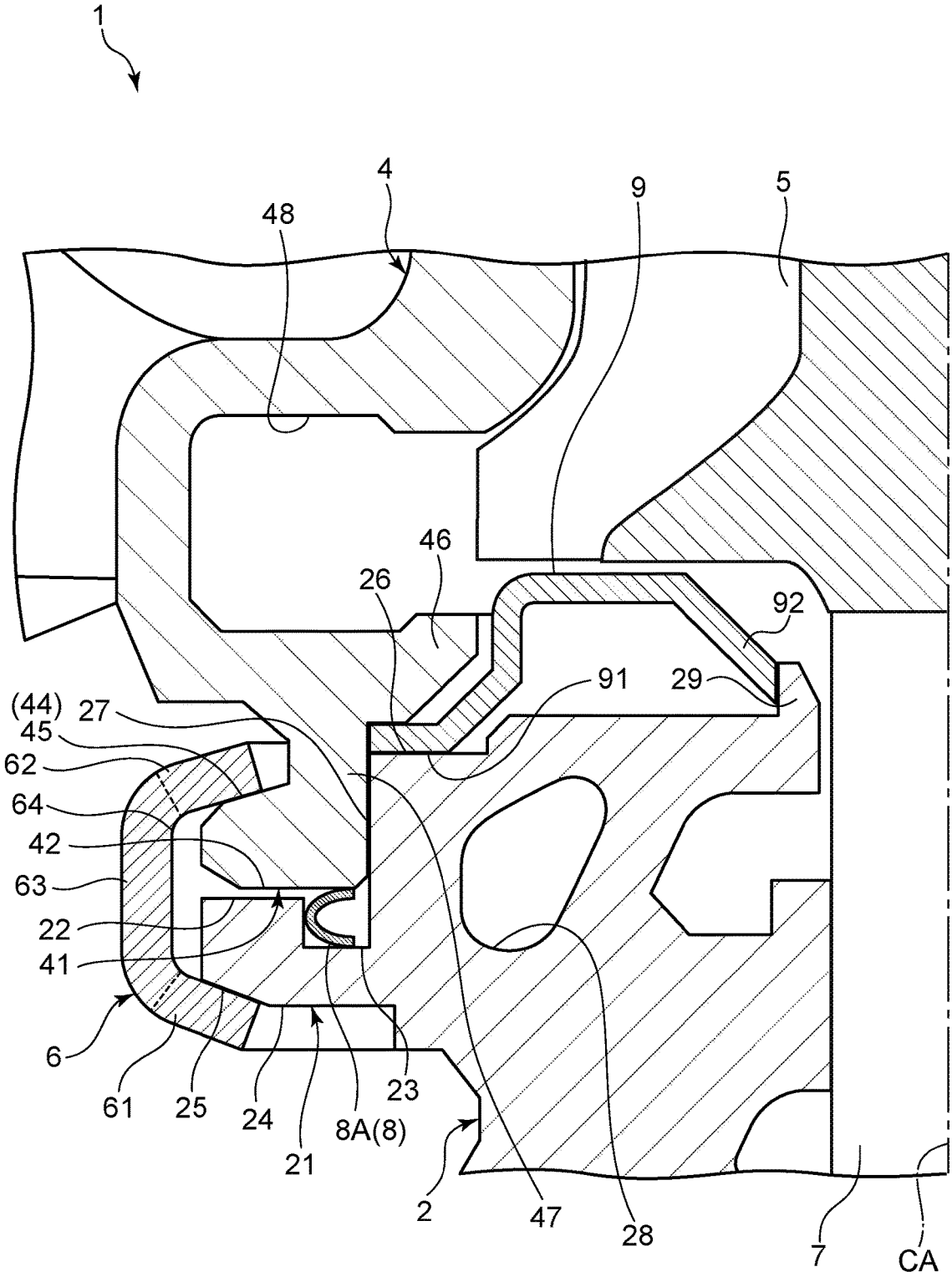
FIG. 3 is an enlarged partial sectional view for explaining a turbocharger according to another embodiment of the present invention, which schematically illustrates the turbocharger with a ring-shaped concave portion formed at a first connection section of a bearing housing.
Figure 4:
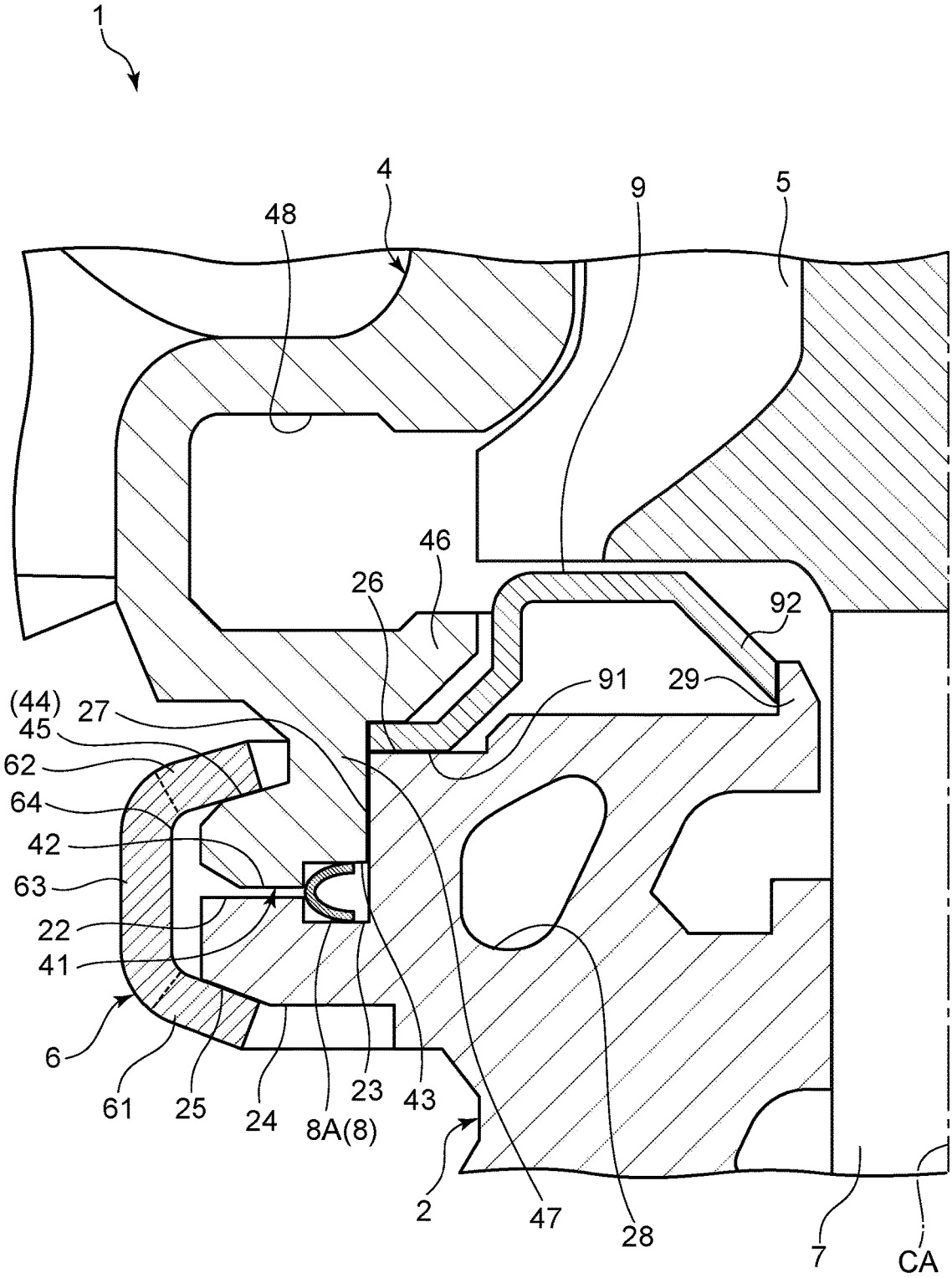
FIG. 4 is an enlarged partial sectional view for explaining a turbocharger according to another embodiment of the present invention, which schematically illustrates the turbocharger with ring-shaped concave portions formed at the first connection section of the bearing housing and the second connection section of the turbine housing.
Figure 5:
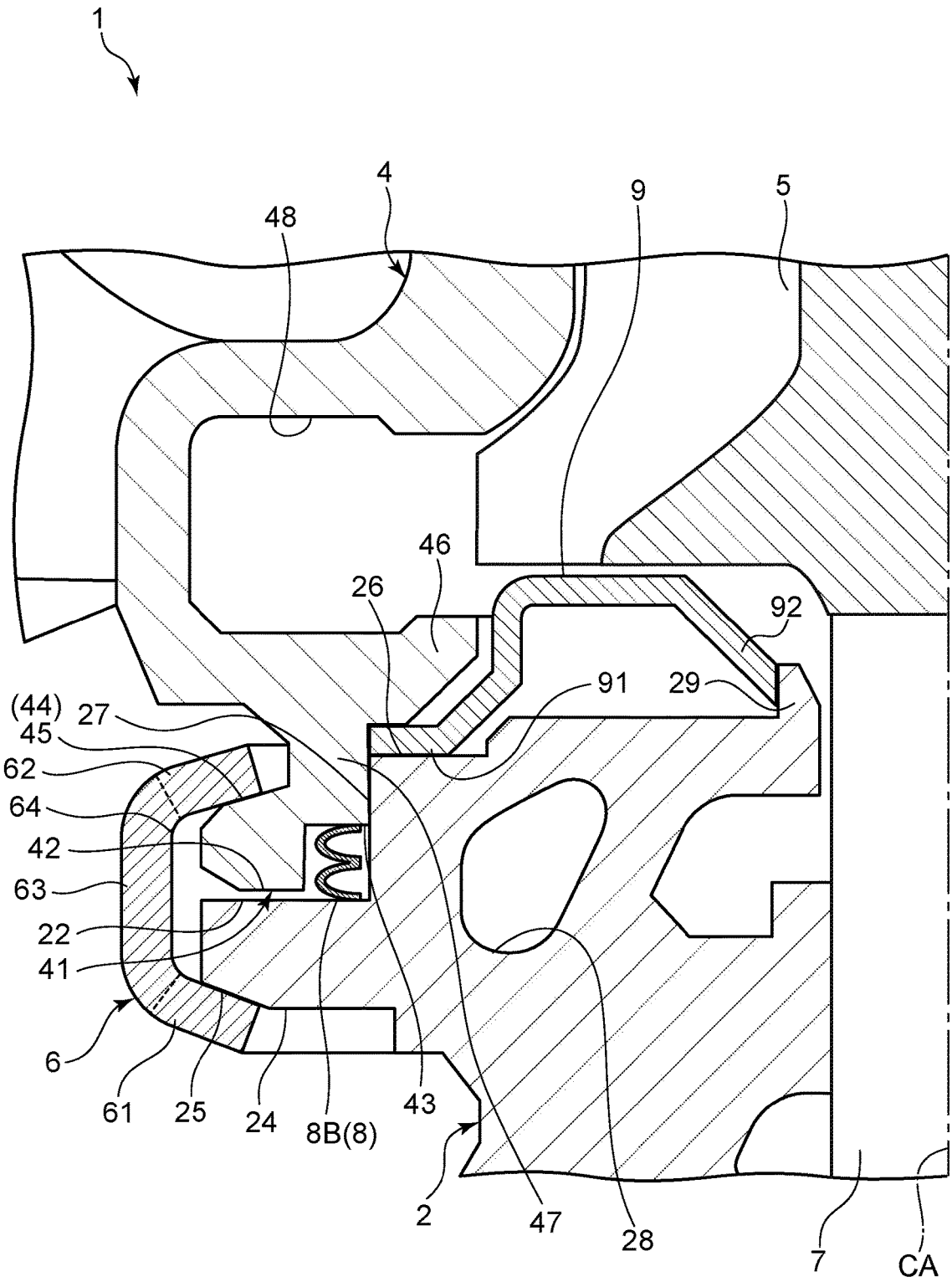
FIG. 5 is an enlarged partial sectional view for explaining a sealing member according to another embodiment of the present invention, which schematically illustrates a turbocharger with a ring-shaped concave portion formed at the second connection section of the turbine housing.

FIGS. 2 to 4 are views for explaining turbochargers of respective embodiments. FIG. 2 is an enlarged partial sectional view schematically illustrating a turbocharger with a ring-shaped concave portion formed at a second connection section of a turbine housing. FIG. 3 is an enlarged partial sectional view illustrating a turbocharger with a ring-shaped concave portion formed at a first connection section of a bearing housing. FIG. 4 is an enlarged partial sectional view illustrating a turbocharger with ring-shaped concave portions formed at the first connection section of the bearing housing and the second connection section of the turbine housing. FIG. 5 is an enlarged partial sectional view for explaining a sealing member according to another embodiment of the present invention, which schematically illustrates a turbocharger with a ring-shaped concave portion formed at the second connection section of the turbine housing. Here, in FIGS. 2 to 5, although boundaries among a first end section 61, a joint section 63, and a second end section 62 are illustrated with dotted lines for explanatory convenience, the sections 61, 63, 62 are integrally formed.

As illustrated in FIGS. 2 to 5, the bearing housing 2 includes a first connection section 21 protruded in the radial direction of the shaft 7 (a direction perpendicular to an extending direction of the center axis CA). As illustrated in FIGS. 2 to 5, the first connection section 21 includes a first face 22 extended in the radial direction on the side toward the turbine wheel 5 (upper side in Figures) in the axial direction of the shaft 7, and a third face 24 formed on the opposite side to the first face 22 in the axial direction.

Further, as illustrated in FIGS. 2 to 5, the bearing housing 2 includes an end face 26 arranged on the side toward the turbine wheel 5 with respect to the first connection section 21 in the axial direction of the shaft 7 and extended in the radial direction of the shaft 7, and an outer side face 27 defined by a step formed between the end face 26 and the first face 22 of the first connection section 21.

As illustrated in FIGS. 2 to 5, the scroll flow path 48 is formed in the turbine housing 4. Further, as illustrated in FIGS. 2 to 5, the turbine housing 4 includes a second connection section 41 arranged on the side toward the first connection section 21 of the bearing housing 2 (lower side in Figures) with respect to the scroll flow path 48 in the axial direction of the shaft 7 and protruded in the radial direction of the shaft 7. As illustrated in FIGS. 2 to 5, the second connection section 41 includes a second face 42 extended in the radial direction on the side toward the first connection section 21 in the axial direction of the shaft 7 and faced to the first face 22, and a fourth face 44 formed on the opposite side to the second face 42 in the axial direction.

Further, as illustrated in FIGS. 2 to 5, the turbine housing 4 includes a back plate supporting section 46 and a fitting section 47. As illustrated in FIGS. 2 to 5, the back plate supporting section 46 is arranged on the side toward the turbine wheel 5 with respect to the second connection section 41 in the axial direction of the shaft 7 and extended radially inward with respect to the second connection section 41 in the radial direction of the shaft 7 to be faced, on the side toward the turbine wheel 5, to the scroll flow path 48. As illustrated in FIGS. 2 to 5, the fitting section 47 is extended in the axial direction of the shaft 7, integrally connected at a lower end thereof to the second connection section 41, and connected at an upper end thereof to the back plate supporting section 46. The fitting section 47 is fitted to the bearing housing 2 with an inner side face thereof opposed to the outer side face 27 of the bearing housing 2.

As illustrated in FIGS. 1 to 5, the uniting member 6 interposes the first connection section 21 and the second connection section 41 by being fitted to the first connection section 21 and the second connection section 41 from the outside.

As illustrated in FIGS. 2 to 5, in the turbocharger 1, at least one of the first face 22 of the first connection section 21 and the second face 42 of the second connection section 41 includes the ring-shaped concave portion 23, 43 arranged on the inner side in the radial direction of the shaft 7 and a sealing member 8 is arranged at the ring-shaped concave portion 23, 43. The sealing member 8 performs sealing between the first connection section 21 and the second connection section 41 as being formed into a ring shape and elastically deformable in the axial direction of the shaft 7.

As described above, the turbocharger 1 according to some embodiments includes the shaft 7, the bearing housing 2, the turbine housing 4, the uniting member 6, and the sealing member 8, as illustrated in FIGS. 2 to 5.

According to the above configuration, as illustrated in FIGS. 2 to 5, the bearing housing 2 includes the first connection section 21 protruded in the radial direction of the shaft 7 and the first connection section 21 includes the first face 22 extended in the radial direction. The turbine housing 4 includes the second connection section 41 protruded in the radial direction of the shaft 7 and the second connection section 41 includes the second face 42 extended in the radial direction and faced to the first face 22 of the first connection section 21. The uniting member 6 interposes the first connection section 21 and the second connection section 41 by being fitted to the first connection section 21 and the second connection section 41 from the outside with the first face 22 of the first connection section 21 and the second face 42 of the second connection section 41 faced to each other.

Thus, since the uniting member 6 is fitted to the first connection section 21 and the second connection section 41 from the outside to interpose the first connection section 21 and the second connection section 41, the turbine housing 4 and the bearing housing 2 can be extended in the axial direction of the shaft 7 due to thermal expansion and thermal deformation under high temperature. Since the turbine housing 4 is more influenced by heat of exhaust gas than the bearing housing 2, the turbine housing 4 is extended in the axial direction of the shaft 7 more than the bearing housing 2. Accordingly, the second connection section 41 becomes close to the first connection section 21 so that clearance between the first face 22 and the second face 42 becomes small or zero. Owing to that the first connection section 21 and the second connection section 41 become close to each other under the thermal influence of exhaust gas, the sealing member 8 arranged at the ring-shaped concave portion 23, 43 on the radially inner side of the first face 22 and/or the second face 42 is urged to be compressed in the axial direction of the shaft 7 by the ring-shaped concave portion 23, 43, the first face 22, and/or the second face 42. Accordingly, since the sealing member 8 is reliably interposed by the ring-shaped concave portion 23, 43, the first face 22, and/or the second face 42, the sealing member 8 can suppress outward leakage of exhaust gas and provide excellent sealing function.

In some embodiments, as illustrated in FIGS. 2 to 5, the uniting member 6 includes the first end section 61 locked on the third face 24, the second end section 62 locked on the fourth face 44, and the joint section 63 joined to the first end section 61 and the second end section 62.

According to the above configuration, as illustrated in FIGS. 2 to 5, since the uniting member 6 includes the first end section 61 locked on the third face 24 of the bearing housing 2, the second end section 62 locked on the fourth face 44 of the turbine housing 4, and the joint section 63 joined to the first end section 61 and the second end section 62, the first connection section 21 and the second connection section 41 are fitted to a fitting concave segment 64 formed by the first end section 61, the second end section 62, and the joint section 63 on the inner side thereof in the radial direction of the shaft 7. Here, as illustrated in FIGS. 2 to 5, since the first end section 61 and the second end section 62 are locked on the third face 24 of the first connection section 21 and the fourth face 44 of the second connection section 41 respectively, the uniting member 6 can prevent the first connection section 21 and the second connection section 41 from being distanced from each other by a predetermined distance or larger in the axial direction of the shaft 7. Accordingly, the sealing member 8 performing sealing between the first connection section 21 and the second connection section 41 can provide excellent sealing function.

In some embodiments, as illustrated in FIGS. 2 to 5, the first connection section 21 includes a taper section 25 formed on the third face 24 so that thickness of the first connection section 21 in the axial direction of the shaft 7 gradually becomes larger toward the inner side in the radial direction of the shaft 7 from an outer circumferential face of the first connection section 21. Further, as illustrated in FIGS. 2 to 5, the second connection section 41 includes a taper section 45 formed on the fourth face 44 so that thickness of the second connection section 41 in the axial direction of the shaft 7 gradually becomes larger toward the inner side in the radial direction of the shaft 7 from an outer circumferential face of the second connection section 41. As illustrated in FIGS. 2 to 5, the first end section 61 and the second end section 62 of the uniting member 6 are extended in directions inclined to the radial direction of the shaft 7 so that distal ends thereof are to be more distanced from each other. As illustrated in FIGS. 2 to 5, the taper section 25 formed on the third face 24 of the first connection section 21 is locked on the first end section 61 of the uniting member 6 and the taper section 45 formed on the fourth face 44 of the second connection section 41 is locked on the second end section 62 of the uniting member 6.

According to the above configuration, as illustrated in FIGS. 2 to 5, the first connection section 21 includes the taper section 25 formed on the third face 24 so that thickness of the first connection section 21 gradually becomes larger toward the inner side in the radial direction of the shaft 7 from the outer circumferential face of the first connection section 21. Further, the second connection section 41 includes the taper section 45 formed on the fourth face 44 so that thickness of the second connection section 41 gradually becomes larger toward the inner side in the radial direction of the shaft 7 from the outer circumferential face of the second connection section 41. Further, the first end section 61 and the second end section 62 of the uniting member 6 are extended in the directions inclined to the radial direction of the shaft 7 so that the distal ends thereof are to be more distanced from each other. Accordingly, since the first end section 61 is locked in the taper section 25 formed on the third face 24 and the second end section 62 is locked in the taper section 45 formed on the fourth face 44, the uniting member 6 can interpose the first connection section 21 and the second connection section 41 in the axial direction of the shaft 7 as well as in the radial direction of the shaft 7. In a case that the second connection section 41 of the turbine housing 4 is extended outward in the radial direction of the shaft 7 due to thermal expansion and thermal deformation under high temperature, fastening force of the uniting member 6 exerted on the first connection section 21 and the second connection section 41 is increased. Accordingly, since the first connection section 21 and the second connection section 41 are firmly interposed by the uniting member 6, the sealing member 8 performing sealing between the first connection section 21 and the second connection section 41 can provide excellent sealing function even under high temperature.

In some embodiments, as illustrated in FIGS. 2 to 5, the turbocharger 1 further includes a back plate 9 arranged between the turbine wheel 5 and the bearing housing 2. As illustrated in FIGS. 2 to 5, the back plate 9 is formed into a ring shape having an outer circumferential edge section 91 and an inner circumferential edge section 92 and has a face on the side toward the turbine wheel 5 in the axial direction of the shaft 7 faced to the turbine wheel 5 and the scroll flow path 48.

As illustrated in FIGS. 2 to 5, the back plate 9 is arranged so that the inner circumferential edge section 92 is fitted to an outer circumference of a protruded section 29 protruded from the end face 26 of the bearing housing 2 in the axial direction of the shaft 7 and the outer circumferential edge section 91 extended in the radial direction of the shaft 7 is interposed between a face of the back plate supporting section 46 opposite to the side toward the turbine wheel 5 in the axial direction of the shaft 7 and the end face 26 of the bearing housing 2. Thus, the back plate 9, the end face 26 of the bearing housing 2, and the back plate supporting section 46 of the turbine housing 4 form a sealing portion 12. The sealing portion 12 performs sealing to prevent outward leakage of exhaust gas. However, sealing at the sealing portion 12 may be deteriorated due to thermal expansion and thermal deformation of the bearing housing 2 and the turbine housing 4 under high temperature.

According to the above configuration, as illustrated in FIGS. 2 to 5, compared to the sealing portion 12 for exhaust gas formed by the back plate 9, the end face 26 of the bearing housing 2, and the back plate supporting section 46 of the turbine housing 4, the first connection section 21 and the second connection section 41 are arranged at positions farther in the axial direction of the shaft 7 from the turbine wheel 5 and the scroll flow path 48 (exhaust gas flow path) through which exhaust gas flows toward the turbine wheel 5. Therefore, temperature increase due to exhaust gas is small and influences due to thermal expansion and thermal deformation are small as well. Accordingly, the sealing member 8 performing sealing between the first connection section 21 and the second connection section 41 can provide excellent sealing function even under high temperature.

Further, temperature increase due to exhaust gas is also small at the sealing member 8 performing sealing between the first connection section 21 and the second connection section 41. Therefore, in a case that the sealing member 8 is formed of a metal material, it is not necessary to adopt expensive heat-resistant alloy. Accordingly, it is possible to prevent cost increase of the sealing member 8 and the turbocharger 1 including the sealing member 8.

In some embodiments, as illustrated in FIGS. 2 and 5, the ring-shaped concave portion 43 is formed at the second connection section 41. In the embodiments illustrated in FIGS. 2 and 5, the sealing member 8 is arranged at the ring-shaped concave portion 43 concaved in the axial direction of the shaft 7 from an inner edge of the second face 42 of the second connection section 41 in the radial direction of the shaft 7. By being arranged between a bottom face of the ring-shaped concave portion 43 and the first face 22 of the first connection section 21, the sealing member 8 performs sealing between the first connection section 21 and the second connection section 41.

According to the above configuration, as illustrated in FIGS. 2 and 5, since the sealing member 8 arranged at the ring-shaped concave portion 43 formed at the second connection section 41 is interposed by the ring-shaped concave portion 43 of the second connection section 41 and the first face 22 of the first connection section 21, the sealing member 8 can provide excellent sealing function. Further, since the sealing member 8 is arranged at the ring-shaped concave portion 43 of the second connection section 41, dropping of the sealing member 8 can be prevented at the time of assembling the bearing housing 2 to the turbine housing 4 and assembling operability can be improved.

In some embodiments, as illustrated in FIG. 3, the ring-shaped concave portion 23 is formed at the first connection section 21. In the embodiment illustrated in FIG. 3, the sealing member 8 is arranged at the ring-shaped concave portion 23 concaved in the axial direction of the shaft 7 from an inner edge of the first face 22 of the first connection section 21 in the radial direction of the shaft 7. By being arranged between a bottom face of the ring-shaped concave portion 23 and the second face 42 of the second connection section 41, the sealing member 8 performs sealing between the first connection section 21 and the second connection section 41.

According to the above configuration, as illustrated in FIG. 3, since the sealing member 8 arranged at the ring-shaped concave portion 23 formed at the first connection section 21 is interposed by the ring-shaped concave portion 23 and the second face 42 of the second connection section 41, the sealing member 8 can provide excellent sealing function. Further, since the sealing member 8 is arranged at the ring-shaped concave portion 23 of the first connection section 21, dropping of the sealing member 8 can be prevented at the time of assembling the turbine housing 4 to the bearing housing 2 and assembling operability can be improved.

In some embodiments, as illustrated in FIG. 4, the ring-shaped concave portion 23 is formed at the first connection section 21. Further, the ring-shaped concave portion 43 is formed at the second connection section 41. In the embodiment illustrated in FIG. 4, the ring-shaped concave portion 23 is formed as being concaved in the axial direction of the shaft 7 from an inner edge of the first face 22 of the first connection section 21 in the radial direction of the shaft 7. Further, the ring-shaped concave portion 43 is formed as being concaved in the axial direction of the shaft 7 from an inner edge of the second face 42 of the second connection section 41 in the radial direction of the shaft 7. By being arranged between a bottom face of the ring-shaped concave portion 23 and a bottom face of the ring-shaped concave portion 43, the sealing member 8 performs sealing between the first connection section 21 and the second connection section 41.

According to the above configuration, since the sealing member 8 is arranged between the ring-shaped concave portion 23 and the ring-shaped concave portion 43 and interposed by the ring-shaped concave portions 23, 43, the sealing member 8 can provide excellent sealing function.

Further, since both the ring-shaped concave portion 23 and the ring-shaped concave portion 43 are formed, the sealing member 8 can be arranged at the ring-shaped concave portion 23 of the first connection section 21 at the time when the turbine housing 4 is assembled to the bearing housing 2 and the sealing member 8 can be arranged at the ring-shaped concave portion 43 of the second connection section 41 at the time when the bearing housing 2 is assembled to the turbine housing 4. Accordingly, dropping of the sealing member 8 can be prevented and flexibility and operability of assembling operation can be improved.

Here, in a case that the turbine housing 4 is formed of, for example, heat-resistant alloy and the bearing housing 2 is formed of a material such as case iron being less expensive and superior in cutting workability than heat-resistance alloy in consideration of the thermal influence difference between the bearing housing 2 and the turbine housing 4, the ring-shaped concave portion 23 is easier to be formed than the ring-shaped concave portion 43.

In some embodiments, as illustrated in FIGS. 2 to 5, the bearing housing 2 further includes a coolant flow path 28 through which coolant flows, the coolant flow path 28 being arranged on the further inner side than the ring-shaped concave portion 23, 43 in the radial direction of the shaft 7. According to the above configuration, since the coolant flow path 28 through which coolant flows is formed in the bearing housing 2 on the further inner side than the ring-shaped concave portion 23, 43 in the radial direction of the shaft 7, temperature increase at the first connection section 21 and the second connection section 41 can be suppressed and thermal expansion and thermal deformation at the first connection section 21, the second connection section 41, and the sealing member 8 arranged therebetween can be lessened. Accordingly, the sealing member 8 can provide excellent sealing function.

Figure 7:
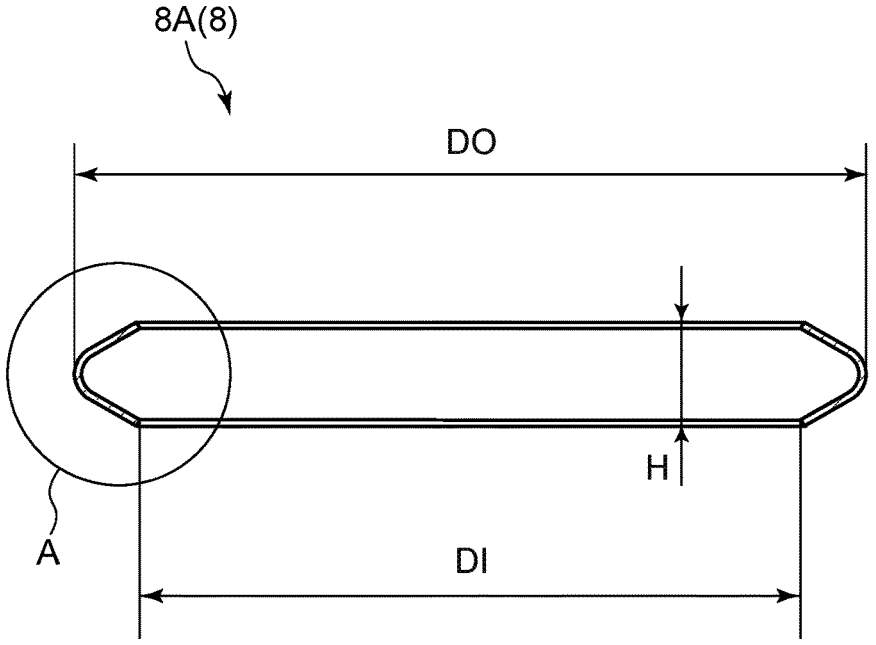
FIG. 7 is a sectional view for explaining a sealing member according to an embodiment of the present invention, which is sectioned in an axial direction of a shaft.
Figure 8:
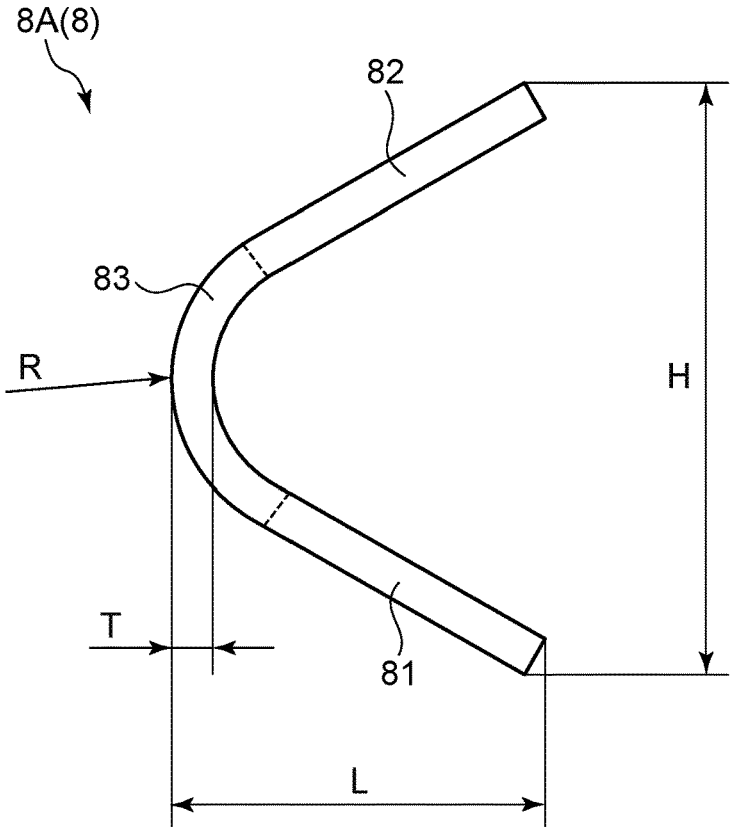
FIG. 8 is an enlarged schematic partial end view of part A in FIG. 7.

FIG. 7 is a sectional view for explaining a sealing member according to an embodiment of the present invention, which is sectioned in an axial direction of a shaft. FIG. 8 is an enlarged schematic partial end view of part A in FIG. 7.

In some embodiments, as illustrated in FIGS. 7 and 8, the sealing member 8 is formed into a ring shape, and in section along the axial direction of the shaft 7, includes a first section 81 to be in touch with the first connection section 21, a second section 82 to be in touch with the second connection section 41, and a curved section 83 having a predetermined curvature to join the first section 81 and the second section 82. In the embodiments illustrated in FIGS. 2 to 4, the sealing member 8 includes a sealing member 8A (C-ring) having a C-shape in section. The sealing member 8A includes the first section 81, the second section 82, and the curved section 83. The first section 81, the second section 82, and the curved section 83 form a concave segment concaved radially-outward on the radially-inner side. In the embodiment illustrated in FIG. 5, the sealing member 8 includes a sealing member 8B (E-ring) having an E-shape in section. The sealing member 8B includes a first section 81, a second section 82, and a curved section 83. The first section 81, the second section 82, and the curved section 83 form two concave segments concaved radially-outward on the radially-inner side.

According to the above configuration, as illustrated in FIGS. 2 to 5, since the sealing member 8 is formed into a ring-shape, sealing can be ensured between the first connection section 21 and the second connection section 41 all over the circumference. Further, as illustrated in FIG. 5, since the sealing member 8 includes the first section 81, the second section 82, and the curved section 83 having the curvature to join the first section 81 and the second section 82, the sealing member 8 is easily compressed in the axial direction of the shaft 7 and a sealing function can be provided with resilience (elastic force) generated by the compression.

Here, compared to the sealing member 8A, the sealing member 8B is easier to be compressed in the axial direction of the shaft 7 to be capable of providing sealing function with resilience (elastic force) generated by the compression.

(Springback Characteristic)

According to findings of the inventors through their studies, excellent sealing function can be provided by the sealing member 8 satisfying a predetermined springback characteristic. The springback characteristic required for the sealing member 8 is calculated through unsteady thermal deformation analysis for the turbocharger 1 with the turbine wheel 5 having a wheel diameter of 20 mm or more and 70 mm or less. In the unsteady thermal deformation analysis, coefficients of thermal expansion of materials for the bearing housing 2 and the turbine housing 4 are assumed to be the same. Here, "the same" does not mean only a case that the coefficients of thermal expansion of the materials for the bearing housing 2 and the turbine housing 4 are completely matched but includes a case that there is a difference between the coefficients of thermal expansion as long as height variance between the first face 22 and the second face 42 due to thermal expansion and thermal deformation of the bearing housing 2 and the turbine housing 4 stays within a range equal to or smaller than a predetermined amount (e.g., 4% or lower of initial height). In the current unsteady thermal deformation analysis, the coefficients of thermal expansion of the bearing housing 2 and the turbine housing 4 are the same as being $8\times10^{-6}$~$22\times10^{-6}$ mm/mm/° C.

Figure 6:
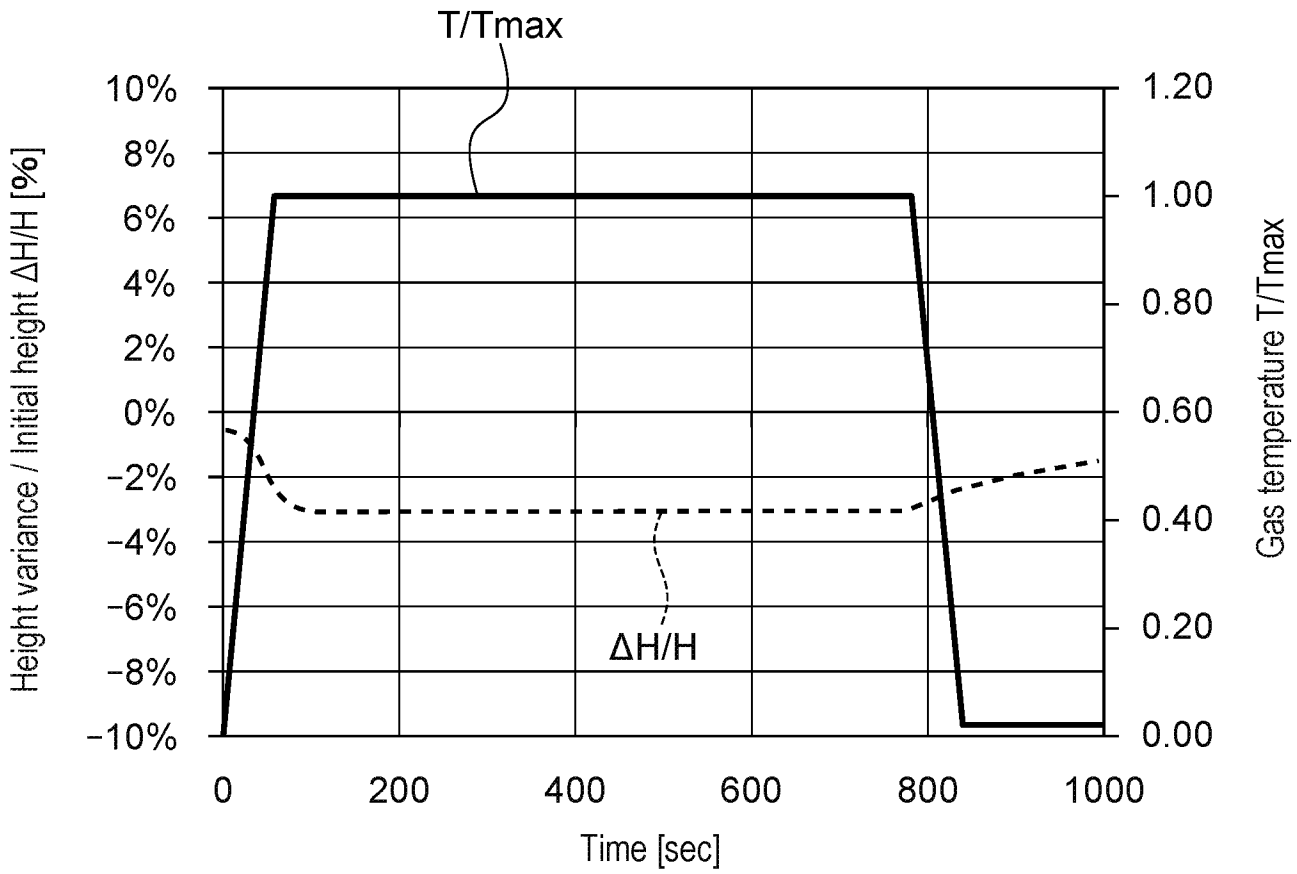
FIG. 6 is a graph illustrating height variance, as ratios with respect to initial height, between a first face and a second face calculated through unsteady thermal deformation analysis for the turbocharger according to the embodiment of the present invention.

FIG. 6 is a graph illustrating height variance, as ratios with respect to initial height, between the first face 22 and the second face 42 calculated through unsteady thermal deformation analysis for the turbocharger 1 according to the embodiment of the present invention. In FIG. 6, T/Tmax illustrated with a solid line represents a value of division of the temperature T of exhaust gas flowing through the scroll flow path 48 by the maximum gas temperature Tmax. In FIG. 6, ΔH/H illustrated with a dotted line represents a value of division of the height variance ΔH between the first face 22 and the second face 42 by the initial height H.

As illustrated in FIG. 6, during operation of the turbocharger 1, the clearance between the first face 22 and the second face 42 is kept narrowed due to thermal expansion and thermal deformation of the bearing housing 2 and the turbine housing 4, so that the height variance is lower than 4% of the initial height. Accordingly, the springback characteristic (elastic deformation amount in the axial direction) required for the sealing member 8 to prevent leakage of exhaust gas is 4% or higher of the initial height.

As illustrated in FIGS. 7 and 8, regarding the sealing member 8A, the outer diameter is denoted by DO mm, the inner diameter is denoted by DI mm, the sectional width is denoted by L mm, height is denoted by H mm, plate thickness is denoted by T mm, and the curvature of the curved section 83 is denoted by R mm. In this case, when the ratio between the height and the plate thickness H/T satisfies "$8.0\leq H/T\leq 25.0$", the ratio between the height and the curvature H/R satisfies "$2.0\leq H/R\leq 6.0$", and the ratio between the height and the sectional width H/L satisfies "$0.5\leq H/L\leq 3.5$", the springback characteristic is kept 4% or higher of the initial height. Here, the sectional width L is calculated through the formula, $L=(DO-DI)/2$.

According to the above configuration, the turbine wheel 5 has a wheel diameter of 20 mm or more and 70 mm or less.

Such turbine wheel 5 is preferable for the turbocharger 1 for automobile use. Further, the coefficients of thermal expansion of the bearing housing 2 and the turbine housing 4 are the same. According to findings of the inventors, excellent sealing function can be provided by the sealing member 8A satisfying the predetermined springback characteristic. Owing to that the sealing member 8A satisfies the above-mentioned conditions, the predetermined springback characteristic can be satisfied in the turbocharger 1 for automobile use and excellent sealing function can be provided.

Not limited to the embodiments described above, the present invention includes various amendments and modifications of the embodiments and appropriate combinations thereof.

REFERENCE SIGNS LIST

1 Turbocharger
2 Bearing housing
21 First connection section
22 First face
23 Ring-shaped concave portion
24 Third face
25 Taper section
26 End face
27 Outer side face
28 Coolant flow path
29 Protruded section
3 Bearing
4 Turbine housing
41 Second connection section
42 Second face
43 Ring-shaped concave portion
44 Fourth face
45 Taper section
46 Back plate supporting section
47 Fitting section
48 Scroll flow path
5 Turbine wheel
6 Uniting member
61 First end section
62 Second end section
63 Joint section
64 Fitting concave segment
7 Shaft
8 Sealing member
81 First section
82 Second section
83 Curved section
9 Back plate
91 Outer circumferential edge section
92 Inner circumferential edge section
10 Impeller
11 Compressor housing
12 Sealing portion
CA Center axis

The invention claimed is:

1. A turbocharger comprising:

a shaft;

a bearing housing accommodating a bearing rotatably supporting the shaft;

a turbine housing accommodating a turbine wheel arranged at one end of the shaft in an axial direction; and a uniting member uniting the bearing housing and the turbine housing, wherein the bearing housing includes a first connection section protruded in a radial direction of the shaft, the first connection section having a first face extended in the radial direction, the turbine housing includes a second connection section protruded in the radial direction of the shaft, the second connection section having a second face extended in the radial direction and being faced to the first face with clearance, and a fitting section fitted to the bearing housing with an inner side face thereof opposed to an outer side face of the bearing housing, the fitting section being positioned on a side of the turbine wheel relative to the ring-shaped concave portion in the axial direction of the shaft, the turbine housing is configured to be extended in the axial direction of the shaft by heat of the exhaust gas flowing in the turbine housing to reduce the clearance between the first face and the second face, the uniting member interposes the first connection section and the second connection section by being fitted to the first connection section and the second connection section from the outside so as to keep the clearance between the first face and the second face, and at least one of the first face and the second face includes a ring-shaped concave portion on an inner side in the radial direction of the shaft with a sealing member arranged at the ring-shaped concave portion, the sealing member being elastically deformable in the axial direction of the shaft.

2. The turbocharger according to claim 1, wherein the turbine housing further includes a back plate supporting section arranged on a side toward the turbine wheel with respect to the fitting section in the axial direction of the shaft and extended radially inward in the radial direction of the shaft, the bearing housing includes an end face formed on a side toward the turbine wheel with respect to the outer side face of the bearing housing in the axial direction of the shaft and extended in the radial direction of the shaft, the turbocharger further comprises a back plate arranged so that an outer circumferential edge section extended in the radial direction of the shaft is interposed between the back plate supporting section and the end face in the axial direction, and the outer circumferential edge of the back place which is interposed between the back place supporting section and the end face is on a side of the turbine wheel relative to the fitting section in the axial direction of the shaft.

3. The turbocharger according to claim 1, wherein the uniting member includes a first end section locked on a third face of the first connection section, the third face being on an opposite side to the first face in the axial direction of the shaft, a second end section locked on a fourth face of the second connection section, the fourth face being on an opposite side to the second face in the axial direction of the shaft, and a joint section joined to the first end section and the second end section.

4. The turbocharger according to claim 3, wherein the first connection section includes a taper section formed on the third face so that thickness of the first connection section gradually becomes larger toward the inner side in the radial direction of the shaft from an outer circumferential face, the second connection section includes a taper section formed on the fourth face so that thickness of the second connection section gradually becomes larger toward the inner side in the radial direction of the shaft from an outer circumferential face, and the first end section and the second end section of the uniting member are extended in directions inclined to the radial direction of the shaft so that distal ends thereof are to be more distanced from each other.

5. The turbocharger according to claim 1, further comprising a back plate arranged between the turbine wheel and the bearing housing, wherein the bearing housing includes an end face formed on a side toward the turbine wheel with respect to the first connection section in the axial direction of the shaft and extended in the radial direction of the shaft, the turbine housing includes a back plate supporting section arranged on a side toward the turbine wheel with respect to the second connection section in the axial direction of the shaft and extended radially inward in the radial direction of the shaft, and the back plate is arranged so that an outer circumferential edge section extended in the radial direction of the shaft is interposed between the back plate supporting section and the end face.

6. The turbocharger according to claim 1, wherein the ring-shaped concave portion is arranged at the second connection section.

7. The turbocharger according to claim 1, wherein the ring-shaped concave portion is arranged at the first connection section.

8. The turbocharger according to claim 1, wherein the ring-shaped concave portion is arranged at the second connection section and the first connection section.

9. The turbocharger according to claim 1, wherein the bearing housing further includes a coolant flow path through which coolant flows, the coolant flow path being arranged on a further inner side than the ring-shaped concave portion in the radial direction.

10. The turbocharger according to claim 1, wherein the sealing member is formed into a ring shape, and in section along the axial direction of the shaft, includes a first section to be in touch with the first connection section, a second section to be in touch with the second connection section, and a curved section having a predetermined curvature to join the first section and the second section.

11. A turbocharger comprising: a shaft;

a bearing housing accommodating a bearing rotatably supporting the shaft;

a turbine housing accommodating a turbine wheel arranged at one end of the shaft in an axial direction;

a uniting member uniting the bearing housing and the turbine housing, and wherein the bearing housing includes a first connection section protruded in a radial direction of the shaft, the first connection section having a first face extended in the radial direction, the turbine housing includes a second connection section protruded in the radial direction of the shaft, the second connection section having a second face extended in the radial direction and being faced to the first face, the uniting member interposes the first connection section and the second connection section by being fitted to the first connection section and the second connection section from the outside, and at least one of the first face and the second face includes a ring-shaped concave portion on an inner side in the radial direction of the shaft with a sealing member arranged at the ring-shaped concave portion, wherein the sealing member is formed into a ring shape, and in section along the axial direction of the shaft, includes a first section to be in touch with the first connection section, a second section to be in touch with the second connection section, and a curved section having a predetermined curvature to join the first section and the second section, and wherein the sealing member has a predetermined springback characteristic under conditions that a sectional width L satisfies $L=(DO-DI)/2$, a ratio between height and plate thickness H/T satisfies "$8.0 \leq H/T \leq 25.0$", a ratio between the height and curvature H/R satisfies "$2.0 \leq H/R \leq 6.0$", and a ratio between height and sectional width H/L satisfies "$0.5 \leq H/L \leq 3.5$", while the turbine wheel has a wheel diameter of 20 mm or more and 70 mm or less, coefficients of thermal expansion of the bearing housing and the turbine housing are the same, and regarding the sealing member, DO denotes an outer diameter, DI denotes an inner diameter, H denotes the height, T denotes the plate thickness, and R denotes the curvature of the curved section.

* * * * *